United States Patent [19]

Rasmussen et al.

[11] Patent Number: 4,674,260

[45] Date of Patent: Jun. 23, 1987

[54] COIN WRAPPING MECHANISM

[75] Inventors: James M. Rasmussen, Chicago; Douglas U. Mennie, West Chicago, both of Ill.

[73] Assignee: Cummins-Allison Corporation, Mt. Prospect, Ill.

[21] Appl. No.: 778,443

[22] Filed: Sep. 20, 1985

[51] Int. Cl.[4] ..... B65B 11/04

[52] U.S. Cl. ..... 53/212; 53/214; 53/216

[58] Field of Search ..... 53/212, 214, 216, 532

[56] References Cited

U.S. PATENT DOCUMENTS

| | | | |
|---|---|---|---|
| 258,528 | 5/1882 | Borchardt | 53/216 X |
| 833,896 | 10/1906 | Rexroth | 53/214 X |
| 1,875,567 | 9/1932 | Daniels | 53/212 |
| 2,661,582 | 12/1953 | Hanser | 53/216 X |
| 2,738,062 | 3/1956 | Edgecombe | 53/214 X |
| 2,882,644 | 4/1959 | Reis . | |
| 2,985,865 | 10/1959 | Costello | 53/214 X |
| 3,296,772 | 1/1967 | Barker | 53/216 X |
| 3,416,291 | 12/1968 | Uchida . | |
| 3,432,983 | 3/1969 | Picollo . | |
| 3,499,455 | 3/1970 | Uchida et al. . | |
| 3,531,913 | 10/1970 | Uchida et al. . | |
| 3,650,086 | 3/1972 | Puhahn et al. . | |
| 3,740,923 | 6/1973 | Itoda et al. . | |
| 3,775,940 | 12/1973 | Hatanaka . | |
| 3,878,666 | 4/1975 | Itoda et al. . | |
| 3,886,957 | 6/1975 | Ushio . | |
| 3,899,864 | 8/1975 | Uchida et al. . | |
| 3,905,176 | 9/1975 | Ushio . | |
| 3,906,964 | 9/1975 | Ushio et al. . | |
| 3,908,338 | 9/1975 | Ushio . | |
| 3,925,966 | 12/1975 | Ushio . | |
| 3,938,303 | 2/1976 | Ushio et al. . | |
| 3,950,921 | 4/1976 | Itoda et al. . | |
| 4,014,155 | 3/1977 | Izawa et al. . | |
| 4,038,806 | 8/1977 | Rothman et al. . | |
| 4,052,839 | 10/1977 | Gross . | |
| 4,058,955 | 11/1977 | Nakai et al. . | |
| 4,060,093 | 11/1977 | Douno . | |
| 4,063,399 | 12/1977 | Nakai et al. . | |
| 4,089,151 | 5/1978 | Bergman et al. . | |
| 4,102,110 | 7/1978 | Iizuka et al. . | |
| 4,123,892 | 11/1978 | Asami . | |
| 4,199,911 | 4/1980 | Miyazaki et al. . | |
| 4,219,985 | 9/1980 | Uchida et al. . | |
| 4,546,875 | 10/1985 | Zweber | 53/214 X |

FOREIGN PATENT DOCUMENTS

| | | | |
|---|---|---|---|
| 2028789 | 12/1971 | Fed. Rep. of Germany | 53/212 |

*Primary Examiner*—John Sipos

*Attorney, Agent, or Firm*—Stephen G. Rudisill

[57] ABSTRACT

A coin wrapping mechanism for wrapping rolls of coins, the mechanism comprising coin stacking means for forming a coin stack containing a predetermined number of coins, a substrate for supporting a selected length of a wrapping material having a coating of a pressure-sensitive, releasable adhesive on the side facing away from the substrate, and wrapping means for bringing the coin stack and the supported length of wrapping material into engagement with each other and then effecting relative movement between the coin stack and the substrate while allowing the coin stack to rotate, whereby the wrapping material is adhered to and wound around the coin stack by the rotation of the coin stack.

22 Claims, 5 Drawing Figures

COIN WRAPPING MECHANISM

FIELD OF THE INVENTION

The present invention relates generally to coin wrapping mechanisms for forming coin rolls.

DESCRIPTION OF RELATED ART

Exemplary coin wrapping machines which are in commercial use today are shown in U.S. Pat. Nos. 3,886,957; 3,905,176; 3,906,964; 3,908,338; 3,925,966; 3,938,303; 3,950,921; 4,089,151; 4,102,110 and 4,412,550. These machines are complicated, requiring an extremely large number of different parts. In operation, these machines have been found to require frequent service, and the attendant down time results in significant losses in productivity. One of the areas that is particularly troublesome is the threading and guiding of the paper web through the machine, and especially the guiding of the paper around the coin stack during the automatic, high-speed wrapping operation. The natural tendency of the paper is to follow a straight path, causing it to fly away from the coin stack and become entangled in the wrapping rolls which drive the coin stack.

SUMMARY OF THE INVENTION

It is a primary object of the present invention to provide an improved coin wrapping mechanism which requires a relatively small number of parts and is highly reliable in operation. In this connection, a related object of the invention is to provide such an improved wrapping mechanism which requires relatively infrequent service with corresponding high productivity rates.

It is another important object of this invention to provide an improved coin wrapping mechanism which is capable of forming wrapped coin rolls at a fast rate and a low cost.

Still another object of the invention is to provide such an improved coin wrapping mechanism which minimizes malfunction and service problems due to entanglement of the wrapping paper with the wrapping mechanism.

A further object of the invention is to provide an improved coin wrapping mechanism which can be efficiently and economically fabricated at a lower cost than present coin wrapping machines capable of operating at comparable production rates.

Other objects and advantages of the invention will be apparent from the following detailed description and the accompanying drawings.

In accordance with the present invention, the foregoing objects are realized by a wrapping mechanism which includes a substrate for supporting a selected length of a wrapping material having a coating of a pressure-sensitive releasable adhesive on the side facing away from the substrate; and wrapping means for bringing a coin stack and the supported length of wrapping material into engagement with each other and then effecting relative movement between the coin stack and the wrapping material while allowing the coin stack to rotate, whereby the wrapping material is adhered to and wound around the coin stack by the rotation of the coin stack. By adhering the leading edge of the wrapping material to the coin stack, the wrapping material is made to follow the rotating coin roll without the use of complicated guiding mechanisms. The wrapping material closely follows the contour of the coin stack as the wrapping material is wound around the entire circumference of the stack, so there are no loose ends or edges to become entangled in the wrapping mechanism. Because the wrapping material is supported on a substrate up until the time it is wound around the coin stack, the wrapping material is under control at all times. This eliminates a large number of parts required in previous wrapping mechanisms, while at the same time improving the reliability of the wrapping operation.

Figure 1:
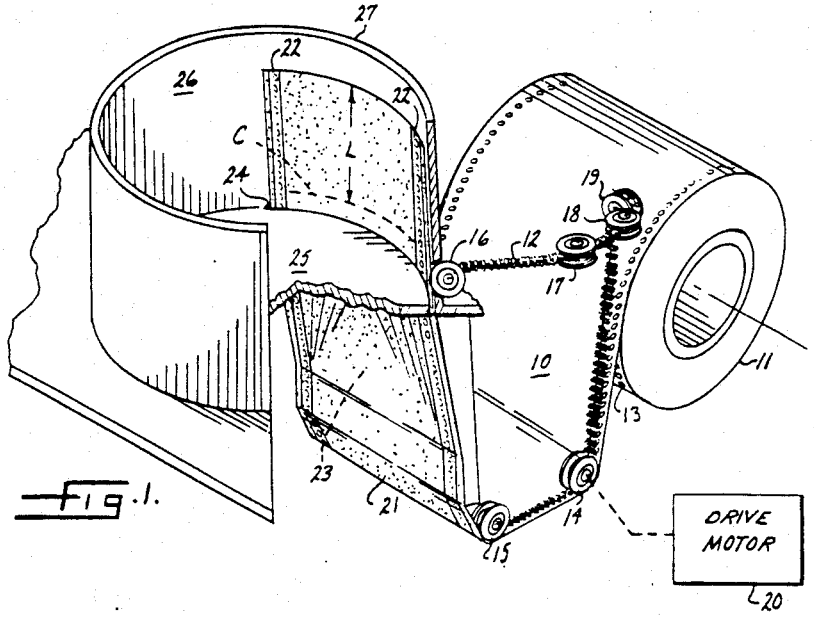
FIG. 1 is a perspective view of the paper feed system for a coin wrapping mechanism embodying the present invention.
Figure 3:
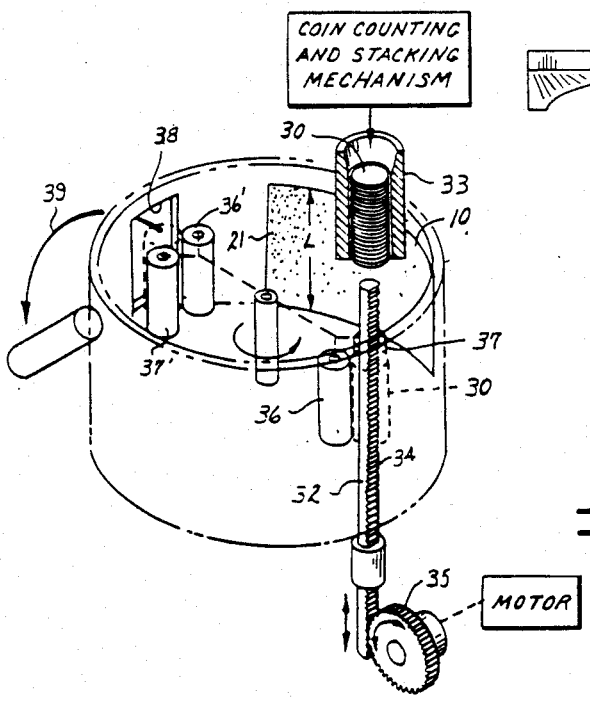
Figure 4:
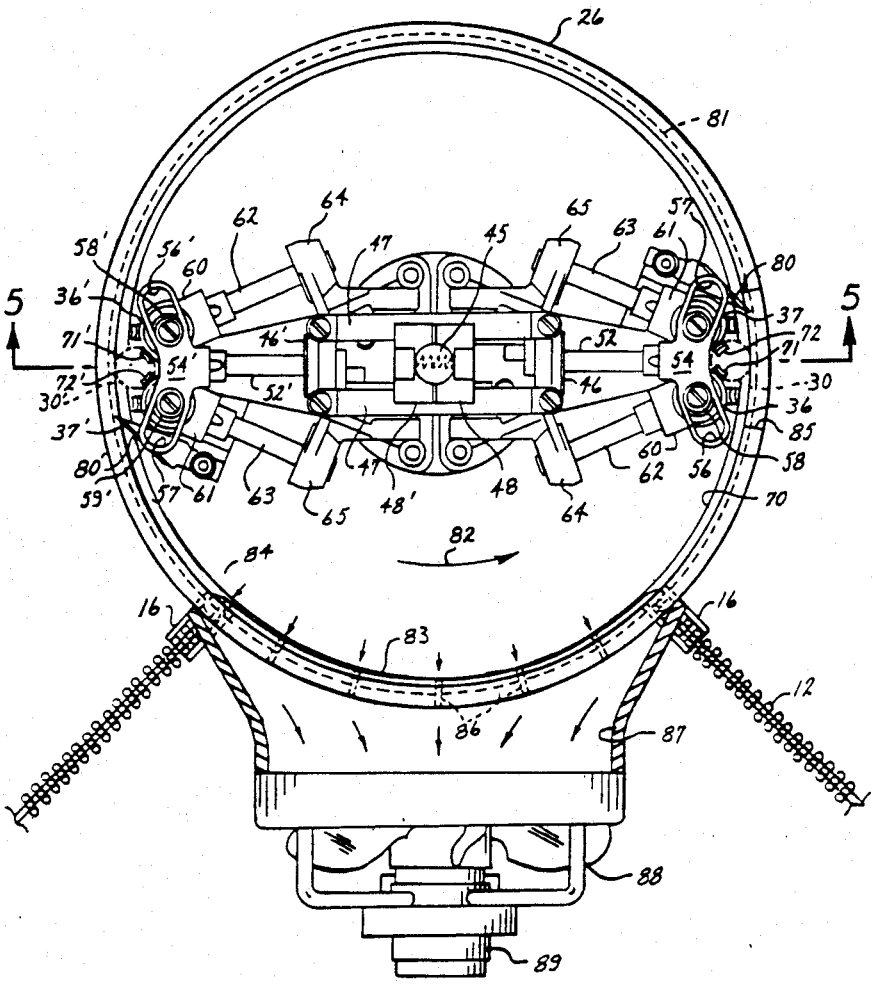
Figure 5:
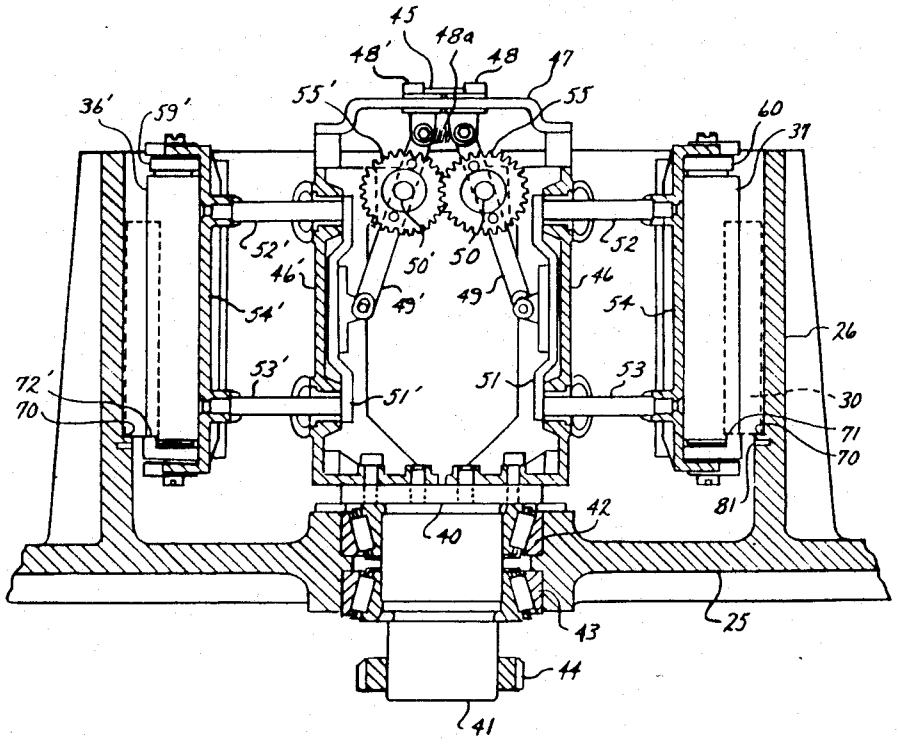

FIG. is a bottom plan view of the paper-forming device in the feed system of FIG. 1;

FIG. 3 is a perspective view of the major elements of a wrapping mechanism for use with the feed system of FIG. 1 in accordance with the invention;

FIG. 4 is a top plan view of a preferred embodiment of a coin roll wrapping mechanism embodying the invention; and FIG. 5 is a section taken generally along line 5—5 in FIG. 3.

DETAILED DESCRIPTION OF PREFERRED EMBODIMENTS

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims.

Figure 2:
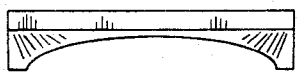

Turning now to the drawings, FIGS. 1, 2 and 3 illustrate the major elements of the wrapping machine that is shown in more detail in FIGS. 4 and 5. FIGS. 1 and 2 illustrate the paper feeding system, and FIG. 3 illustrates the coin loading and wrapping system.

Referring first to FIG. 1, the wrapping material 10, which is preferably paper but may be a plastic film, is withdrawn from a supply roll 11 by means of a pair of "three-dimensional" sprocket belts 12 meshing with two corresponding rows of sprocket holes 13 in the paper web. A "three-dimensional" sprocket belt is a commercially available item comprising a flexible metal cable having polymeric sprockets fastened to the cable at equal intervals along the length thereof; each sprocket has four lugs projecting therefrom at 90° intervals around the axis of the cable. Each of the sprocket belts 12 is trained around a set of six sprocket wheels 14–19, with the wheel 14 being driven by an electric drive motor 20.

One side of the paper web 10 is coated with a pressure-sensitive releasable adhesive 21, such as the adhesives disclosed in U.S. Pat. No. 4,418,120 as having good tack and shear properties but low peel adhesion to stainless steel. That is, the adhesive should adhere quickly to the outer surface of a stack of coins and have sufficient shear strength to hold the stack of coins together during handling, and yet have a peel adhesion low enough to permit the paper to be readily peeled off the coin roll without leaving any substantial residue of adhesive on the coins. The adhesive coating 21 is preferably continuous along the full length, and across the full width, of the paper web 10, except for two strips 22 which are left uncoated to facilitate the punching of the sprocket holes 13.

As the paper web 10 is withdrawn from the supply roll 11, it is driven upwardly over a forming surface 23 and then through an arcuate slot 24 formed in a base plate 25. As the paper web 10 emerges from the top of the slot 24, it follows the inside wall 26 of a rigid metal cylinder 27. The forming surface 23 slopes toward the cylinder wall 26 and is curved across the width of the paper web 10 so that the web is curled as it passes over the forming surface. As can be seen in FIGS. 1 and 2, the radius of curvature of the forming surface 23 is steadily reduced as it approaches the slot 24 so that it curls the paper web 10 to a radius of curvature matching that of the outer wall of the slot 24.

To maintain positive control of the paper while it is being curled, the sprocket wheels 16 penetrate through cutouts in the tapered portion of the cylinder 27 directly above the slot 24, and grooves are formed in the outer wall of the slot 24 and the forming surface 23 directly below the cutouts to pass the sprocket belts 12. This arrangement permits the sprocket belts 12 to remain engaged with the paper web 10 as it passes upwardly over the forming surface 23 and through the slot 24.

The curling of the paper provides it with a degree of stiffness which permits it to continue to be driven upwardly along the cylinder wall 26, after the web 10 becomes disengaged from the sprocket wheels 16. This upward movement is continued until the length L of the paper web extending above a cutting plane C is substantially the same as the height of the coin stack to be wrapped. There is no need to provide extra lengths of paper at opposite ends of the coin stack for "crimping", as is required in conventional wrapping machines, because the adhesive coating 21 on the paper 10 obviates the crimping operation. If desired, however, the paper length L may be slightly longer than the height of the coin stack to allow for variations in coin thickness due to wear and manufacturing tolerances, and/or to allow the extra lengths of paper to be folded over and releasably bonded to the ends of the coin roll.

In accordance with one important feature of the present invention, the wrapping material is fed into the wrapping mechanism along a path transverse, preferably perpendicular, to the direction of wrapping of the coin stack so that only the minimum length of wrapping material need be fed into the wrapping mechanism for the wrapping of each coin roll. The length of paper wrapped around the circumference of each stack of coins is normally greater than the height of the coin stack because it is generally desirable to wind several layers of the paper around the coins. Thus, by feeding the wrapping material in the direction of its shorter dimension (in the final coin roll) the feeding time is minimized, and the length of paper that must be supported after it leaves the sprocket belts is also minimized.

Referring now to FIG. 3, while the desired length L of the paper web 10 is being fed upwardly along the cylinder wall 26, a coin stack 30 is lowered into the wrapping cylinder 27. The coin stack 30, which contains a prescribed number of coins of a given denomination, may be formed by any of a variety of different coin counting and stacking mechanisms, such as the one described in Nakamura et al. U.S. Pat. No. 4,515,172. Such stacking mechanisms typically have a shutter which opens each time it is desired to load a new coin stack into the wrapping mechanism. When the shutter opens, the coin stack 30 drops onto the upper end of a vertically movable rod 32 which lowers the coin stack through a guide tube 33 leading to the wrapping mechanism inside the cylinder 27. In the illustrative embodiment, the rod 32 has a rack 34 formed in one side thereof and meshing with a motor-driven pinion gear 35 for moving the rod up and down.

As can be seen in FIG. 3, the coin stack 30 is lowered between a pair of wrapping rollers 36 and 37 within the cylinder 27. These wrapping rollers 36 and 37 are vertically aligned with the length L of the paper web 10 on the cylinder wall 26, and are mounted for orbital movement around the axis of the cylinder 27. Because the coin stack 30 is captured between the rollers 36 and 37 and the cylinder wall 26, the orbital movement of the rollers has the effect of rolling the coin stack 30 along the cylinder wall 26 and onto the adhesive-coated side of the paper web 10. As soon as the coin stack 30 engages the paper 10, the adhesive coating thereon adheres to the outer edges of the coins.

There is enough clearance between the two rollers 36 and 37 and the cylinder wall 26 to allow the stack of loose coins to be lowered into the wrapping mechanism. The three support points provided by the two rollers 36 and 37 and the cylinder wall 26 confine the loose coins and maintain the integrity of the stack. The three support points also allow the loose coins to be rolled along the cylinder wall at a high speed even though they are not being held under pressure. As the coin stack 30 rolls along the cylinder wall 26 it comes into contact with a resilient rubber pad mounted on the wall 26, as will be described in more detail below. When the coin stack meets the pad, the stack is forced up a ramp which leads the stack onto the pad, thus creating the pressure required for urging the adhesive-coated paper and the coin stack together.

Continued rolling movement of the coin stack 30 along the adhesive-coated surface of the paper causes the paper length L to wind around the coin stack. The entire circumferential length of the web length L is wound around the coin stack 30 within an orbital path of less than 180°. Thus, the orbital movement of the rollers 36 and 37 is stopped every 180° to discharge the wrapped roll of coins through an aperture 38 in the cylinder 26, as indicated by the arrow 39 in FIG. 1. At the same time, a new coin stack 30 is lowered between a second pair of wrapping rollers 36' and 37' which follow the same orbital path as the rollers 36 and 37 but 180° out of phase therewith.

FIGS. 4 and 5 illustrate an actual machine for carrying out the feeding and wrapping operations illustrated in FIGS. 1–3. Because the two halves of this mechanism are exact mirror images of one another, the parts of one half of the mechanism will be identified by the same reference numerals which identify corresponding parts in the other half, with the addition of a distinguishing prime to the reference numerals for the parts of one half of the mechanism.

The entire movable portion of the wrapping mechanism is supported on a flange 40 on the end of a driven spindle 41 mounted for rotation in two sets of roller bearings 42 and 43 in the base plate 25 of the wrapping cylinder 27. The lower end of the spindle 41 carries a gear 44 which is connected to a suitable drive means (e.g., a step motor) for rotating the spindle 41 in 180° steps.

As the spindle 41 and the base plate 25 are rotated, they carry with them a central frame formed by a pair of columns 46 and 46' which are rigidly fastened to the base plate 24 by machine screws. The upper ends of the columns 46 and 46' are connected by a crown 47 which also serves as a track for a pair of adjustment members 48 and 48' which are biased toward each other by a spring 48*a*. The tops of the adjustment members 48, 48' form a pair of adjustment lugs between which a coin 45 of any desired denomination can be inserted to space the members 48, 48' apart by a distance proportional to the size of the coin inserted therein. Thus, the larger the coin, the farther the members 48 and 48' are spaced apart along the track formed by the crown 47.

Each time the spacing of the adjustment members 48 and 48' is adjusted, the radial positions of the two pairs of wrapping rollers 36, 37 and 36', 37' are automatically adjusted by a mechanism comprising a pair of control arms 49 and 49' mounted for pivoting movement about fixed shafts 50 and 50'; a pair of yokes 51 and 51' connecting the lower ends of the respective control arms 50 and 50' to the ends of respective pairs of sliding rods 52, 52' and 53, 53'; and a pair of brackets 54 and 54' fastened to the outer ends of the rods 52, 52' and 53, 53' for positioning the wrapping rollers 36, 37 and 36', 37'.

To interconnect the two halves of the adjustment mechanism connected to the two adjustment members 48 and 48', the shafts 50 and 50' carry two pairs of meshing gears 55 and 55'. Because of this gear connection, movement of either of the adjustment members 48 and 48' along the crown 47 always results in a corresponding movement of the other adjustment member, thereby ensuring that the two halves of the adjustment mechanism are always moved in synchronism with each other and by precisely the same amounts.

In order to properly position the wrapping rollers 36, 37 and 36', 37' in response to adjusting movement of the rods 52, 53 and 52', 53', the upper and lower ends of the brackets 54 and 54' form camming slots 56, 57 and 56', 57' (see FIG. 4). These camming slots receive cam follows 58, 59 and 58', 59' on the shafts of the respective wrapping rollers 36, 37 and 36', 37' so that the wrapping rollers are cammed to different positions, determined by the shape of the camming slots 56, 57 and 56', 57', whenever the rods 52, 53 and 52', 53' are adjusted. Since the adjusting movement of the rods 52, 53 and 52', 53' is determined by the particular denomination of coin inserted between the two adjustment members 48 and 48', the camming slots 56, 57 and 56', 57' are designed to move the wrapping rollers to precisely the desired position for each different coin denomination. That is, the diameter of a circle touching the surfaces of the two rollers 36 and 37 and the cylinder wall 26 (see the broken line circles 30 and 30' in FIG. 4) should be just slightly larger than the diameter of the particular coin denomination to be wrapped.

To support the wrapping rollers in fixed vertical positions, each wrapping roller 36 or 37 is mounted on its own bracket 60 or 61, respectively. The shafts of the wrapping rollers extend through the horizontal arms of these brackets 60 and 61, and the brackets in turn are fastened to upper and lower pairs of guide rods 62 and 63 extending inwardly therefrom through corresponding bosses 64 and 65 on the corners of the support column 46. The rods 62 and 63 are slidably supported within the bosses 64 and 65 to permit the wrapping rollers 36 and 37 to move back and forth along the axes of these rods in response to the camming action described above. Of course, the other pair of wrapping rollers 36' and 37' are equipped with similar brackets 60' and 61' fastened to guide rods 62' and 63' extending through bosses 64' and 65'.

It can be seen that when the control arms 49, 49' are pivoted in response to the insertion of a coin of any given denomination between the two adjustment members 48, 48', the radial positions of the wrapping rollers 36, 37 and 36', 37' are automatically adjusted to accommodate stacks of coins of the same denomination. The adjustability of this mechanism is universal in the sense that it can be stopped anywhere between its end limits, so that it can accommodate any number of different coins. This permits the same mechanism to be used for coins of different countries, for example.

After the wrapping rollers 36, 37 and 36' and 37' have been positioned to receive stacks of coins of the desired denomination, the rod 32 is lowered to load a stack of such coins into the wrapping cylinder 26. This rod 32 passes between a set of three supports 70, 71 and 72 which engage the bottom of the coin stack 30 and remove it from the rod 32 as the top of the rod descends below the pads. These supports 70–72 engage the bottom of the coin stack 30 throughout the wrapping operation and permit the coin stack to be rotated as it is rolled around the cylinder surface 26. The outermost support 70 is formed by a shoulder on the inside wall of the cylinder 27, while the two inner supports 71 and 72 are formed as parts of the roller brackets 59, 60 and 59', 60'.

In accordance with another feature of the invention, cutting means are provided for cutting the wrapping material 10 along a line just below the bottom of the coin stack during the winding of the paper around the coin stack. Thus, in the machine of FIGS. 4 and 5, a cutting knife 80 extends into a shallow groove 81 formed around the inside surface of the cylinder surface 26. The knife 80 is located on the leading side of the coin stack 30 so that the paper 10 is cut ahead of the coin stack 30, thereby detaching the paper length L from the web 10 so that the length L can be wound around the coin stack 30 as the stack is rolled along the adhesive-coated surface of the paper.

To effect the wrapping of a coin stack 30 after it has been deposited on the supports 70–72, the spindle 41 is rotated in the direction indicated by the arrow 82 in FIG. 4. This moves the wrapping rollers 36, 37 in the same direction, carrying the coin stack 30 with them along the cylinder surface 26 and the adhesive-coated surface of the paper 10. To ensure that the paper 10 is pressed into firm engagement with the coin stack 30, the portion of the cylinder surface 26 that serves as a substrate for the paper length L is lined with a resilient pad 83. The leading vertical edge 84 of the pad 83 is beveled so that the coin stack 30 rolls smoothly across the edge of the pad and onto the paper 10, compressing the pad so that the pad applies a biasing pressure on the paper to urge it against the coin stack 30. The pad 83 extends along the full circumferential length of the paper 10, so that the biasing pressure is applied throughout the wrapping of the coin stack 30.

After the coin stack 30 has been rolled across the entire circumferential length of the paper 10 by the orbiting movement of the wrapping rollers 36, 37, the spindle 41 continues to move the rollers to a position diametrically opposed to the position where the coin stack 30 was initially loaded. This 180° movement of the wrapping rollers 36, 37 brings the wrapped roll of coins into register with an aperture 85 in the cylinder 26, through which the wrapped coin roll can be discharged from the wrapping cylinder.

To ensure that the curled paper length L remains against the pad 83 and thereby avoid paper jams, a light vacuum is preferably applied to the paper surface facing the pad 83. Thus, as illustrated in FIG. 4, both the pad 83 and the corresponding portion of the cylinder wall are perforated, as at 86, with the outer ends of the perforations opening into a manifold 87 leading to a suction fan 88. A motor 89 drives the fan 88 to exhaust air from the manifold 87 and thereby draw the paper 10 firmly against the pad 83.

As can be seen from the foregoing detailed description, this invention provides an improved coin wrapping mechanism which requires only a small number of parts and is highly reliable in operation. Consequently, the mechanism requires infrequent service and provides correspondingly high productivity rates. Specifically, the mechanism minimizes malfunction and service problems due to entanglement of the wrapping paper with the wrapping mechanism. This improved wrapping mechanism is capable of forming wrapped coin rolls at a fast rate and a low cost, and can also be efficiently and economically fabricated at a lower cost than present coin wrapping machines capable of operating at comparable production rates.

I claim:

1. A coin wrapping mechanism for wrapping rolls of coins, said mechanism comprising coin stacking means for forming a coin stack containing a predetermined number of coins, a stationary substrate for supporting a selected length L of a wrapping material having a coating of a pressure-sensitive, releasable adhesive on the side facing away from said substrate, wrapping means for bringing said coin stack and said supported length of wrapping material into engagement with each other and then rolling said coin stack along the adhesive-coated surface of said wrapping material on said substrate while pressing the coin stack and the wrapping material together and while holding the coins together in said stack, whereby said wrapping material is adhered to and wound around the coin stack by the rotation of the coin stack, means for feeding said selected length of wrapping material onto said substrate in a direction perpendicular to the direction of the rolling movement of the coin stack and parallel to the axis of the coin stack, said feeding means having means for adjustment of said length L to permit the wrapping of coins of different denominations, and thus different coin roll lengths, on a common substrate with common wrapping and feeding means and without using wrapping materials of varying widths, and means for cutting said selected length of wrapping material off a continuous supply web in advance of the rolling of the coin stack over said selected length.

2. The coin wrapping mechanism of claim 1 wherein said substrate is the inside surface of a hollow cylinder, and said wrapping means includes means for rolling said coin stack around the inside surface of said cylinder, and which includes means for feeding said selected length of wrapping material onto the inside surface of said cylinder from one end of the cylinder.

3. The coin wrapping mechanism of claim 1 wherein the height of said wrapping material is substantially the same as the height of the coin stack.

4. The coin wrapping mechanism of claim 1 wherein said wrapping material has two rows of sprocket holes, and is fed by a driven sprocket mechanism meshing with said sprocket holes.

5. The coin wrapping mechanism of claim 4 wherein said adhesive coating on said wrapping material is substantially continuous except for the strips containing said sprocket holes.

6. The coin wrapping mechanism of claim 1 wherein said cutting means cuts off said wrapping material adjacent one end of said coin stack prior to or during the winding of said wrapping material around said coin stack.

7. The coin wrapping mechanism of claim 6 wherein said means for cutting off said wrapping material comprises a knife positioned adjacent said one end of said coin stack for slicing said wrapping material as it is wound around said coin stack.

8. The coin wrapping mechanism of claim 1 which includes means for feeding said selected length of wrapping material onto said substrate while curling the wrapping material about an axis parallel to the axis of said coin stack.

9. The coin wrapping mechanism of claim 1 which includes means for urging said selected length of wrapping material against said coin stack during the rotation of said coin stack.

10. The coin wrapping mechanism of claim 1 wherein said substrate includes an arcuate wall for supporting said selected length of wrapping material and said wrapping means includes means for rolling said coin stack over said arcuate wall and the wrapping material supported thereby to effect the winding of said wrapping material around said coin stack.

11. The coin wrapping mechanism of claim 10 wherein said means for rolling said coin stack includes a pair of idler rolls for urging said coin stack against said arcuate wall.

12. The coin wrapping mechanism of claim 11 which includes means for adjusting the positions of said idler rolls to accommodate stacks of coins of different denominations.

13. The coin wrapping mechanism of claim 12 wherein said adjusting means includes a pair of adjustment means for receiving coins of different denominations therebetween, and means connecting said adjustment means to said idler rolls for adjusting the positions of said idler rolls according to the spacing between said adjustment means as determined by the coin denomination inserted therebetween.

14. The coin wrapping mechanism of claim 1 which includes vacuum means for drawing said wrapping material against said substance so that said coin stack can be rolled smoothly over said wrapping material on said substrate.

15. The coin wrapping mechanism of claim 1 which includes a resilient pad disposed between said wrapping material and said substrate, and means for pressing said coin stack against said wrapping material during the rotating of the coin stack so that the resiliency of said pad urges said wrapping material firmly against the rotating coin stack.

16. A coin wrapping mechanism for wrapping rolls of coins, said mechanism comprising coin stacking means for forming a coin stack containing a predetermined number of coins, feed means for repetitively feeding a selected length L of the end portion of a continuous web of wrapping material into a position adjacent said coin stack, said wrapping material having a coating of a pressure-sensitive, releasable adhesive on the side facing said coin stack, means for engaging an edge portion of said wrapping material with said coin stack so that said adhesive adheres to the coin stack, drive means for rotating said coin stack about its axis so that said wrapping material is wound around the coins and releasably bonded thereto, and means for holding the coins together in said stack during the wrapping thereof, said feed means feeding said selected length of wrapping material in a direction perpendicular to the direction of winding of said wrapping material onto said coin stack, said feeding means having means for adjustment of said length L to permit the wrapping of coins of different denominations, and thus different coin roll lengths, on a common substrate with common wrapping and feeding means and without using wrapping materials of varying widths

17. The coin wrapping mechanism of claim 16 wherein said selected length of wrapping material is supported on a stationary surface during the rotation of the coin stack, and said coin stack is rolled over the adhesive-coated surface of wrapping raterial.

18. The coin wrapping mechanism of claim 17 which includes means for cutting off said selected length of wrapping material adjacent one end of said coin stack prior to or during the winding of said wrapping material around said coin stack.

19. The coin wrapping mechanism of claim 18 wherein said means for cutting off said wrapping material comprises a knife positioned adjacent said one end of said coin stack for slicing said wrapping material as it is wound around said coin stack.

20. The coin wrapping mechanism of claim 17 which includes vacuum means for drawing said wrapping material against said stationary surface.

21. The coin wrapping mechanism of claim 17 wherein said stationary surface is curved in the direction of the winding movement, and which includes means for feeding said selected length of wrapping material onto said stationary surface while curling the wrapping material about an axis parallel to the axis of said coin stack.

22. The coin wrapping mechanism of claim 16 which includes means for urging said selected length of wrapping material against said coin stack during the rotation of said coin stack.

* * * * *